United States Patent [19]

Holce

[11] 4,213,110

[45] Jul. 15, 1980

[54] PROXIMITY SWITCH HAVING ADJUSTABLE SENSITIVITY

[76] Inventor: Thomas J. Holce, 10905 SW. 5th #250, Beaverton, Oreg. 97005

[21] Appl. No.: 926,443

[22] Filed: Jul. 20, 1978

[51] Int. Cl.[2] ..... H01H 36/00

[52] U.S. Cl. ..... 335/207; 335/153; 335/205

[58] Field of Search ..... 335/207, 206, 153, 205

[56] References Cited

U.S. PATENT DOCUMENTS

| | | | |
|---|---|---|---|
| 3,252,057 | 5/1966 | Hoeppel | 335/153 |
| 3,806,852 | 4/1974 | Suska | 335/205 |
| 3,974,469 | 8/1976 | Nicholls | 335/153 |

FOREIGN PATENT DOCUMENTS

| | | | |
|---|---|---|---|
| 1142055 | 2/1969 | United Kingdom | 335/153 |
| 1145633 | 3/1969 | United Kingdom | 335/153 |

*Primary Examiner*—Harold Broome

*Attorney, Agent, or Firm*—Chernoff & Vilhauer

[57] ABSTRACT

A magnetically operated reed switch device for use in physical security monitoring systems, machinery control systems, and the like, having a biasing permanent magnet associated therewith for providing adjustable sensitivity to the proximity of an actuating permanent magnet. The reed switch is enclosed in a cylindrical glass capsule and the biasing magnet is mounted near the capsule, with its axis of magnetic polarity parallel to an elongate reed of the reed switch, in a position adjustable along the longitudinal axis of the reed by an adjustment screw for controlling the sensitivity of the reed switch. The biasing magnet may be mounted on a screw-driven carriage or on the end of a screw moving within a tube parallel to the reed. The device is actuated by increased magnetic flux density provided by the actuating magnet, which is attached to the movable object whose position is being monitored. The switch device and its actuating magnet are fixed in protective housings having mounting means.

10 Claims, 9 Drawing Figures

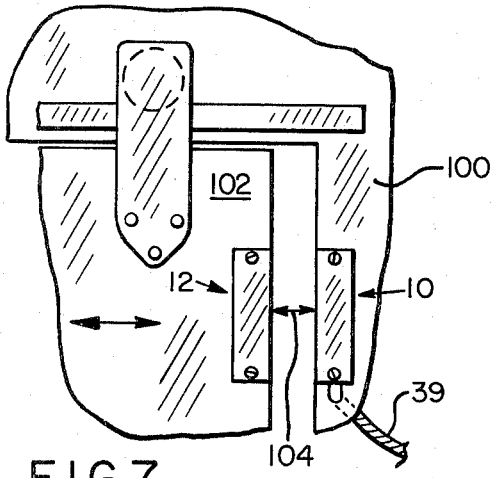
FIG.7
FIG.1
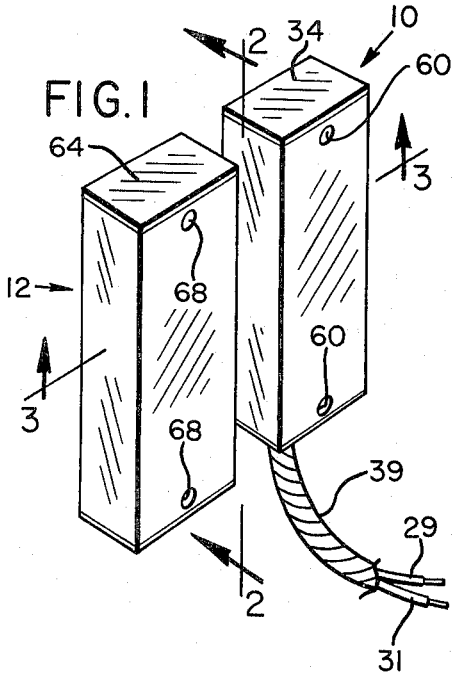
FIG.2
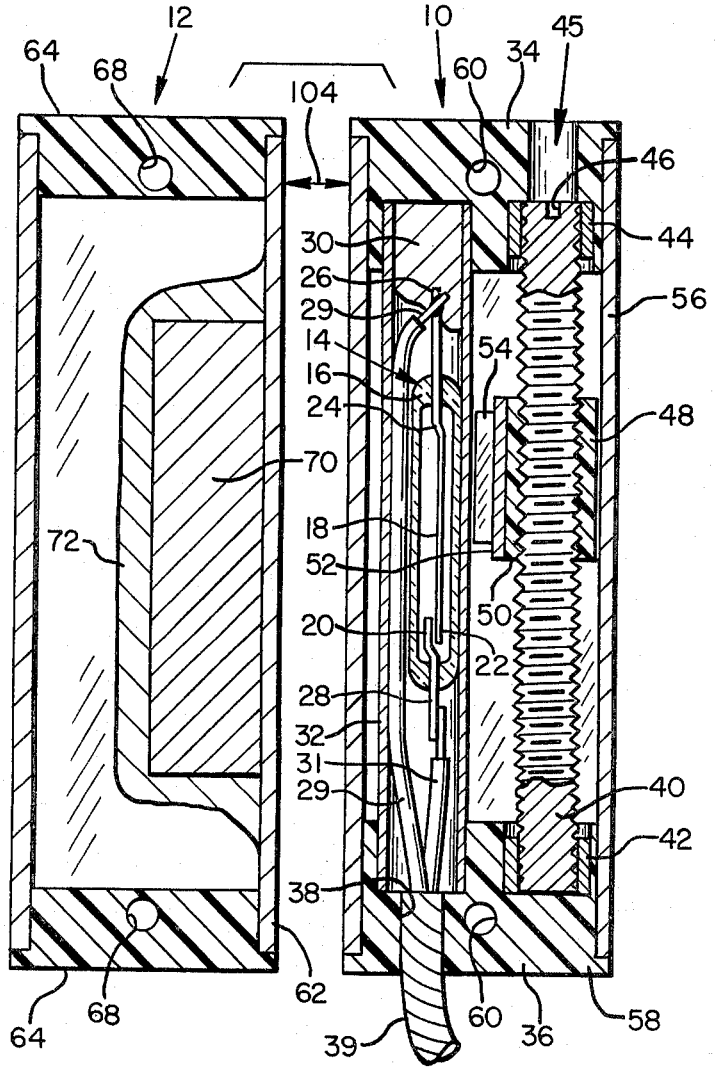
FIG.3
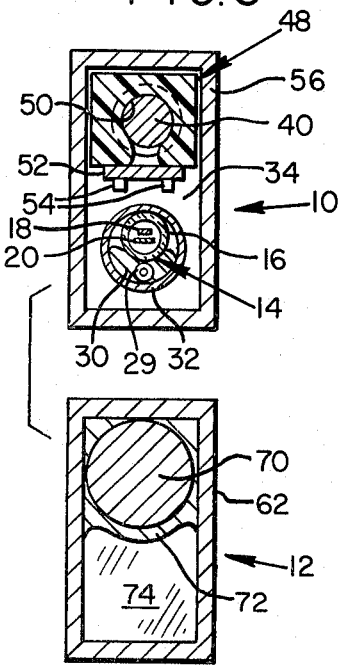

PROXIMITY SWITCH HAVING ADJUSTABLE SENSITIVITY

BACKGROUND OF THE INVENTION

This invention relates to improvements in magnetically actuated reed switch devices, and particularly to those using permanent magnet biasing means for controlling the sensitivity of a reed switch to changes in surrounding magnetic flux density.

A reed switch comprises a cylindrical glass capsule containing electrical contacts attached to magnetic material, that is, material which becomes magnetized in the presence of a magnetic field, at least one such contact being carried on a movable end of a flexible blade, or "reed", of magnetic material.

Such a reed switch is operated by increasing the magnetic flux density in the vicinity of its magnetic portions which induces increased magnetism in those portions, thereby causing the reed to be attracted toward another magnetic component of the reed switch by the magnetism. When the magnetic flux density is sufficiently reduced, the reed is released and the reed switch resumes its normal condition. In various forms of reed switches the electrical contacts may move either to close or open an electrical circuit under the influence of a magnetic field in a single-pole-double-throw switch, or the reed-carried contact may move from a closed position with respect to a non-magnetic fixed contact to a closed position with respect to a magnetic fixed contact in a single-pole-double-throw switch.

In security systems, such magnetic reed switches have previously been used in conjunction with an actuating permanent magnet, which, when close enough to a reed switch, provides the increase in magnetic flux density to actuate it. The sensitivity of a reed switch to such actuation is limited, however, and use of such a reed switch in a security system application requires either a fairly strong actuating magnet or an installation providing a very small gap between the actuating magnet and the sensing reed switch.

Normally the security device reed switch and its associated electrical conductors leading to a security system control unit and alarm device are mounted in or on the frame surrounding a doorway or window opening, and the actuating magnet is located in or on the door or window sash so that movement of the door or window from a predetermined position moves the actuating magnet and thereby allows the reed switch to release, or resume its normal condition, producing an electrical signal detected by the monitoring security system control unit.

This application of reed switches has in the past required extremely careful alignment between the switch and the actuating magnet. The low sensitivity of the reed switch has caused the reliability of such security switches to be less than desired, since a slight movement of the actuating magnet could allow the magnetically held contacts to be released, particularly in environments including magnetic materials such as steel fire doors. For example, reed switches installed to monitor a door might produce false alarms if wind gusts cause the door to shift slightly, or switches installed to monitor overhead or sliding doors can produce erroneous indications of the position of such doors because of minor misalignment of such doors in their tracks.

A characteristic of reed switches, known as hysteresis, is that once an actuating magnet has approached a reed switch closely enough to cause actuation, the switch will remain magnetically actuated as the actuating magnet is withdrawn to a greater distance before the switch releases or resumes its normal state. This characteristic is important because it is usually desirable in security applications to have actuation and release occur at as nearly as possible the same point, particularly where there is little relative motion between an actuating magnet and a switch.

For example, when a security switch and its actuating magnet are mounted in the hinge sides of a door and doorway respectively, the switch should release before the edge of the door opposite the hinges is clear of the doorway. Also, it is desirable to mount the switch and actuating magnet in one of the hinges, to make installation simple and unauthorized actuation more difficult. The characteristic hysteresis separation between actuation and release points of ordinary magnetic reed switches, however, makes such installation less sensitive to small movements than is desirable.

The use of larger actuating magnets mounted on doors and windows to allow insensitive reed switches to remain actuated despite small movements of doors and windows reduces the number of false alarms, but makes such a magnetic switch more easily detected and located by a magnetometer and thus less secure from tampering. Moreover, larger actuating magnets also increase the effect of hysteresis. Additionally, the material used in producing the actuating magnets is not inexpensive, and larger magnets appreciably increase the cost of the devices.

As in security systems, magnetically actuated switches are useful in relay systems controlling machines, and problems similar to those occurring in a security system also occur in that environment.

One means of increasing the sensitivity of such a reed switch is to place a permanent magnet near the switch to bias the reed by providing part of the magnetic flux density necessary for actuation. Permanent magnet bias means for controlling the sensitivity of reed switches have been previously disclosed, for example, by variation of the distance or angular relationship between the magnet and the longitudinal axis of the reed of the switch, as shown in Nicholls U.S. Pat. No. 3,974,469, and by varying the location of the reed along an imaginary axis parallel to the axis of polarity of the biasing magnet, as shown by Tann U.S. Pat. No. 3,305,805. However, the device of the Nicholls patent requires either a threaded hole through the biasing magnet, in order to vary its distance, or a disc-shaped rotatable magnet and socket to vary its angular relationship, both of which are somewhat expensive and complicated means of attachment, and Tann shows no apparatus for holding the axis of polarity of a magnet parallel to the reed of a reed switch. Also, while Tann shows a means of adjustment of the position of a reed switch relative to a magnet, only discrete, not continuous variations of position are provided. Thus a need exists for an inexpensively manufactured, magnetically actuated proximity switch which has continuously adjustable sensitivity and is particularly suitable for use in physical security monitoring systems or position control systems.

SUMMARY OF THE INVENTION

The aforementioned drawbacks of prior art magnetically actuated switches adopted for use in security systems or proximity-sensing relay applications are overcome by the present invention, which provides novel adjustable mounting means for a biasing magnet near a reed switch to create a switch device which is particularly useful for security system monitoring, and is also suitable for other types of proximity sensing applications.

In the device of the invention a reed switch is fixedly located in a housing, and a small permanent magnet is mounted with its axis of polarity, that is, an imaginary line connecting its poles, parallel to the reed of the reed switch, so that it is movable parallel to the axis of the reed, thereby providing an adjustable magnetic biasing field to control the sensitivity of the reed switch to the additional magnetic field of an actuating magnet. Adjusting the sensitivity of the reed switch by varying the position of the biasing magnet adjusts the distances between the switch and the actuating magnet at which the switch will actuate and release for a given actuating magnet. The device of the invention thus allows the use of a smaller actuating magnet for a given separation between the switch and the actuating magnet, making the device less expensive to produce, more easily concealed from sight, and more difficult to detect and locate by magnetometer.

In one embodiment of the invention the small permanent biasing magnet is adhesively fastened to the end of an adjustment screw disposed within a plastic tube which is mounted parallel to the reed of the switch and has threads which mate with the screw. The small biasing magnet may thereby be moved to an appropriate position to predispose the reed of the switch to move in response to the field of the actuating magnet at a distance greater than that possible without the biasing magnet. Conversely, the biasing magnet may also be adjusted to require the actuating magnet to be closer than for an unbiased reed switch, which reduces the effect of hysteresis, making the actuation and release distances more nearly equal, and allowing the switch to release upon a very small movement of the actuating magnet away from the switch, compared to a similar reed switch without a biasing magnet.

In another embodiment of the invention the biasing magnet is adhesively fixed to a carrier that generally comprises a rectangular piece of plastic including a partial cylinder having interior threads which fit matingly around an adjustment screw rotatably mounted parallel to the reed of the reed switch. As the adjustment screw is turned the carrier and the attached biasing magnet are thereby moved parallel to the reed to adjust the sensitivity of the switch.

In the latter embodiment the switch is enclosed in a protective metal casing which is suitable for exposed mounting, as on exterior doors and gates. Where the gap between the door or gate and a doorway frame or latch post, respectively, is large, or the door or gate is likely to be moved by the wind, the movable biasing magnet allows the switch to be adjusted to the desired degree of sensitivity.

Because the biasing magnet is attached in close proximity to the reed switch, the total amount of magnetic material needed to operate the switch using a given gap is less than that which would be required with no biasing magnet.

In a common security monitoring application, the switch of the invention is mounted in the frame of a doorway or window, while the actuating magnet is mounted in the edge of the door or the window sash. Final adjustment of the response of the switch to movement of the door or window may be made after installation by turning the adjustment screw to vary the placement of the biasing magnet relative to the reed of the switch.

As may be appreciated from the foregoing, the switch of the invention may be adjusted to be very sensitive to the actuating magnet and to remain actuated even though the gap between switch and actuating magnet is large and the door or gate is shaken. Alternatively, the switch and magnet may be mounted on the hinge side of a door, with the biasing magnet's location adjusted to require the actuating magnet to be very close to the reed switch for actuation. In the latter installation the effect of hysteresis is minimized, bringing the actuation point and the release point very close together, and switching action occurs very reliably at the desired point.

It is therefore a principal objective of this invention to provide an improved magnetically actuated switch of adjustable sensitivity.

It is a further objective of the invention to provide a magnetically actuated switch which may be adjusted after installation to provide a desired degree of sensitivity.

It is another objective of this invention to provide a switch which may be adjusted to reduce the hysteresis effect and to release reliably upon a small movement of the actuating magnet.

It is yet another objective of the invention to provide a magnetically actuated switch which, is relatively inexpensive, may easily be installed in a concealed and protected location, and is less easily detected by magnetometers.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of a proximity switch embodying the present invention.

FIG. 2 is a sectional view of the proximity switch shown in FIG. 1, taken along line 2—2 of FIG. 1.

FIG. 3 is a sectional view of the proximity switch shown in FIG. 1, taken along line 3—3 of FIG. 1.

FIG. 7 illustrates a typical installation of the switch shown in FIG. 1.

DETAILED DESCRIPTION OF THE INVENTION

Figure 8:
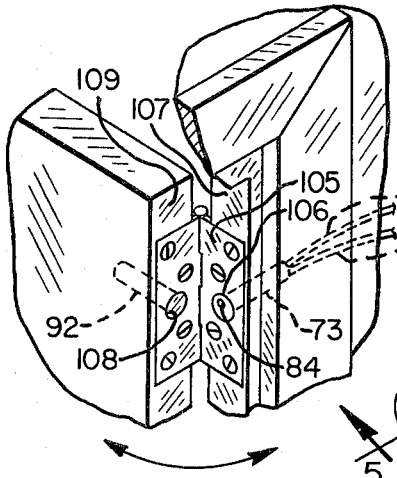
FIG. 8 is a fragmentary, partially cut away view of a typical installation of the switch shown in FIG. 4.

Referring to FIGS. 1, 2 and 3, illustrating a first embodiment of the invention, a magnetically actuated switch unit 10 and an actuating magnet unit 12 are shown in the normal relationship causing actuation of the switch. An exemplary reed switch 14, enclosed in an elongate, generally cylindrical glass capsule 16, comprises a magnetic reed 18 and a fixed magnetic contact 20. The end of the magnetic reed 18 farthest from the fixed magnetic contact 20 is fixedly mounted in the glass capsule 16, and the magnetic reed 18 is flexible enough to allow a second contact 22, carried on the reed, to be moved into contact with the fixed magnetic contact 20 by their mutual magnetic attraction induced by the influence of a magnetic field such as that of the actuating magnet. The magnetic reed and contact may best be made of an alloy such as 50% iron and 50% nickel which has high permeability and low retentivity. A fixed end 24 of the magnetic reed 18 is connected electrically to a first conductor 26 and the fixed magnetic contact 20 is connected electrically to a second conductor 28. Both the first and second conductors extend outwardly through the glass capsule 16, with the first conductor 26 being connected to a conductor lead 29 which extends along the glass capsule and thence parallel to the second conductor, and the second conductor 28 being connected electrically to a conductor lead 31.

The reed switch 14, conductors 26 and 28, and the leads 29 and 31 are embedded in potting compound 30 within a non-magnetic tube 32 which may be of plastic material. The potting compound may be an epoxy, a room temperature vulcanizing rubber, or any similar composition which sets up quickly in place, without shrinkage which would unduly strain the capsule of the reed switch. Thus the reed switch 14 is easily fixed in its proper location within the tube 32. The tube 32 is fixedly located between a first end piece 34 and a second end piece 36, and conductor leads 29 and 31 extend through an aperture 38 in the second end piece 36 into a sheathed cable 39.

An adjustment screw 40, which is threaded over its entire length and slightly tapered at each end, is located parallel to the tube 32, and has its ends respectively rotatably held in a bushing 42 mounted in the second end piece 36 and a bushing 44 mounted in the first end piece 34. An access opening 45 extends through the first end piece, exposing a screwdriver slot 46 provided in one end of the adjustment screw 40. A carrier 48, which may be made from extruded plastic, has internal threads which mate with the threads of the adjustment screw so that the carrier rides upon the adjustment screw and moves along the screw in response to the rotation thereof. The carrier is a generally rectangular prism in outward appearance and defines therein an open-sided partial cylinder 50 which resiliently grips around the adjustment screw 40, providing resistance to undesired rotation of the adjustment screw. The taper of the ends of the adjustment screw facilitates assembly, so that the adjustment screw itself taps the threads within the carrier.

A piece of double faced adhesive tape 52 attached across the open side of the cylinder 50 holds a pair of small elongate biasing magnets 54, which may for example be of alnico V or alnico VIII, with like polarity orientation and with their axes of polarity parallel to the reed 18. A protective tubular metal switch housing 56 fits slidingly over the tube, adjustment screw and carrier, with the interior walls of the housing slidingly fitting against the exterior of the carrier to prevent it from rotating when the adjustment screw is turned. Each end piece is slidingly fitted into its respective end of the switch housing to receive the ends of the tube and adjustment screw, and is adhesively fastened in place. Mounting holes 60 extend through the switch housing 56 and the end pieces 34 and 36, allowing the switch housing to be secured by screws to the surface of a door frame, window frame, or the like where the switch is to be used.

The actuating magnet unit 12 comprises a non-magnetic metal magnet housing 62, closed at each end by a plastic end piece 64 which is adhesively fixed in place. An actuating magnet 70, aligned with a polarity orientation the same as the biasing magnets, is adhesively secured, preferably by potting material 72, within the magnet housing 62. A mounting hole 68 at each end is provided through the magnet housing and end pieces for securing the actuating magnet to the surface of an object upon which it is to be used.

Figure 4:
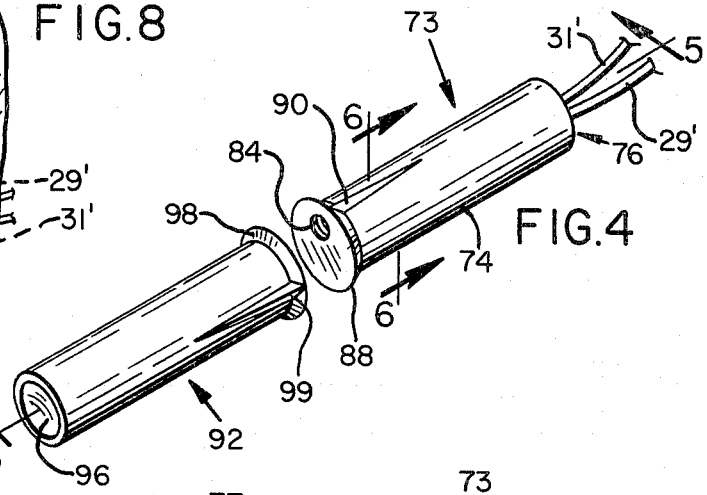
FIG. 4 is a perspective view of another proximity switch embodying the invention.
Figure 5:
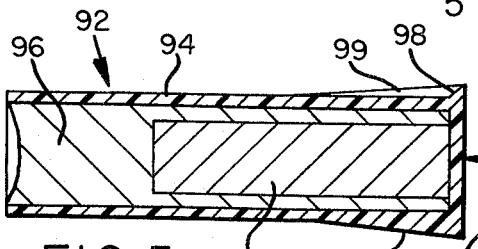
FIG. 5 is a sectional view of the proximity switch shown in FIG. 4, taken along line 5—5 of FIG. 4.
Figure 6:
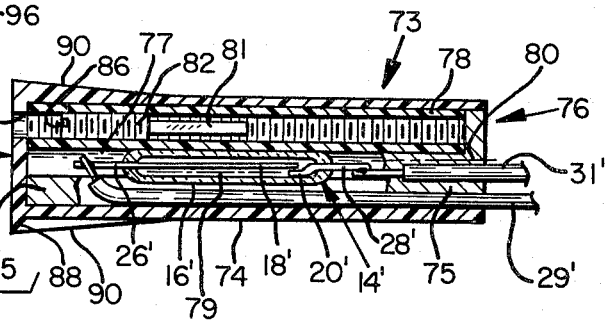
FIG. 6 is a sectional view of the proximity switch shown in FIG. 4, taken along line 6—6 of FIG. 4.
Figure 6:
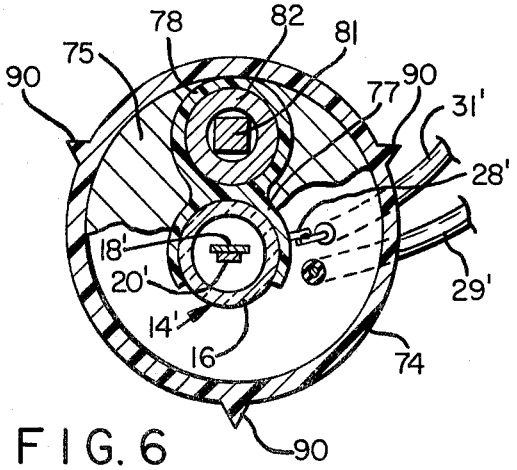

Referring to FIGS. 4, 5 and 6, a second embodiment of the invention is seen wherein a switch unit 73 comprises a reed switch 14' which is adhesively mounted in a channel 77 attached and parallel to an elongate tube 78, both of which may be made of extruded plastic, and is secured by potting material 75 within a plastic switch housing 74 such that a longitudinal axis 79 of the reed switch is parallel to a longitudinal axis 80 of the housing. A magnetic reed 18' of the reed switch 14' is substantially parallel to the axis of the tube 78. A first conductor 26' extends outwardly from the reed switch 14', and is connected to a lead 29' which extends past the reed switch through an open end 76 of the switch housing 74. A second conductor 28' of the reed switch is connected to a lead 31' which extends directly outward through the open end of the housing.

An elongate biasing magnet 81 is adhesively attached to the end of a set screw 82 held by mating threads inside the tube 78, with the biasing magnet in close proximity to the reed switch 14', and an access aperture 84 defined in a closed end 85 of the switch housing 74 is aligned with the tube 78. A screwdriver may be inserted through the access aperture to a screwdriver slot 86 in the set screw 82 to adjust the position of the biasing magnet 81 along the longitudinal dimension of the reed.

The closed end 85 of the switch housing has a flange 88 to limit insertion of the housing into a mounting hole to a position flush with the surface into which such a hole is drilled. A plurality of elongate deformable tapered retainers 90, having their widest ends closest to the closed end 85 of the housing, cooperate to wedgingly secure the housing in position.

An actuating unit 92 comprises an elongate permanent actuating magnet 93 which is mounted within an elongate actuating magnet housing 94 by a potting compound 96 such that the axis of polarity of the magnet is parallel to the longitudinal axis of the housing. The magnet housing 94, like the switch housing 74, comprises a tubular main portion having a closed end 97 including a flange 98 and a plurality of retainers 99 which are identical in design and use to the flange and retainers of the switch housing 74. Thus, in this embodiment, the switch unit is actuated when its closed end is placed adjacent the closed end of the actuating unit such that their longitudinal axes are substantially colinear.

Although the invention has been described above using for illustration a single-pole-single-throw reed switch having normally-open contacts, the invention also comprehends use of a single-pole-double-throw reed switch. In that case two fixed contacts are present, with the reed-carried contact movable between closing with a non-magnetic contact and closing with a magnetic contact when a sufficiently strong magnetic field is present. This provides separate closed circuits to indicate positively both the presence and the absence of such a magnetic field.

In FIG. 7, a typical installation of the switch of FIGS. 1, 2 and 3 is shown, in which a switch unit 10 is mounted on a door frame 100 and an actuating magnet unit 12 is mounted on a sliding door 102. The conductor leads 29 and 31 are hidden within the wall surrounding the doorway. When the door 102 is closed, the actuating magnet 12 is adjacent to the switch unit 10, and the switch device is magnetically actuated. When the door is opened beyond a predetermined distance, the gap 104 between the switch unit 10 and the magnet 12 exceeds a predetermined actuation gap and allows the switch to release. The switch may be adjusted by turning the adjustment screw 44, moving the carrier 48 and the associated biasing magnets 54 to adjust the magnetic biasing field in the vicinity of the switch and thus allow the switch to actuate when the actuating magnet is within a desired distance. Care must be taken, however, that the sensitivity is not too greatly increased; otherwise the biasing magnet alone may hold the contacts in the magnetically actuated position after withdrawal of the actuating magnet because of the effect of hysteresis. When properly adjusted, the switch contacts will release when the actuating magnet is removed beyond a predetermined distance, producing an electrical circuit change sensed by a security system control unit (not shown).

Referring to FIG. 8, a typical installation of the switch of FIGS. 4, 5 and 6 can be seen, wherein the switch housing 74 is installed in a leaf of a door hinge 105, extending through a switch mounting hole 106 into a doorway frame 107. The actuating magnet unit 92 is similarly installed through a hole 108 located in the other leaf of the same hinge, in alignment with the switch mounting hole 106, and extends into the edge of a door 109. When the door is opened beyond a predetermined distance, the actuating magnet unit 92 is effectively separated from the switch unit 73 by a distance exceeding a predetermined release gap 110, see FIG. 5, causing a signal to be sent by way of conductors 29′ and 31′ to a remote sensing unit (not shown). In an installation of this nature the biasing magnet 80 is usually adjusted to reduce the sensitivity of the reed switch 14′ to proximity of the actuating magnet 93, thereby reducing the effect of hysteresis and allowing the reed switch 14′ to release reliably upon a very slight displacement of the actuating magnet away from its position in alignment with the switch when the door is closed.

Figure 9:
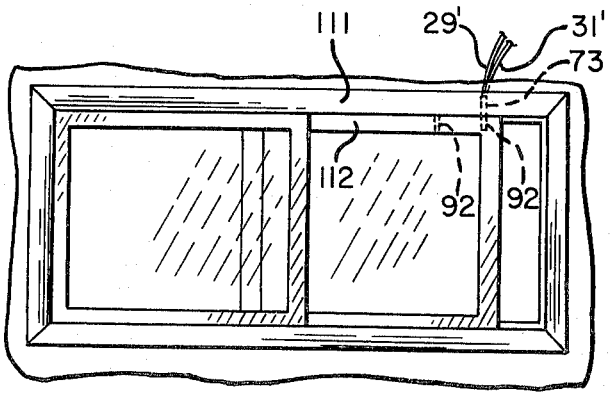
FIG. 9 is another typical installation of the switch shown in FIG. 4.

Referring to FIG. 9, another typical installation of the switch of FIGS. 4, 5 and 6 is shown, wherein a switch unit 73 is installed in the frame 111 surrounding a sliding window. A pair of actuating magnet units 92 are installed in the sash 112 of the window in positions where one magnet unit is aligned with the switch unit when the window is closed and another magnet unit is aligned with the switch unit when the window is opened a predetermined distance to allow ventilation. Movement of the window sash misaligning an actuating magnet and switch allows the switch to release producing a signal as previously described.

In this type of installation the position of the biasing magnet 81 might be adjusted to increase the sensitivity of the switch 14′ so that the switch 14′ would remain in the magnetically actuated position despite slight misalignment of the sliding window, to accommodate changes of temperature or humidity, vibration, or looseness of the sliding sash in its guides. This adjustment would, of course, be subject to the previously described limitation due to the effect of hysteresis.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A switch device for controlling an electrical circuit in response to the presence of an external magnetic field, said device comprising:
   (a) a reed switch having at least a first contact and a second contact, said reed switch including magnetic reed means for causing relative movement between said contacts in response to the presence of an external magnetic field, said magnetic reed means having a longitudinal axis;
   (b) an elongate permanent biasing magnet having an axis of polarity;
   (c) screw means for moving said elongate permanent biasing magnet parallel to said longitudinal axis for adjusting the sensitivity of said reed switch to said external magnetic field; and
   (d) adhesive means for attaching said elongate permanent biasing magnet to said screw means such that said axis of polarity is parallel to said longitudinal axis of said magnetic reed means and a predetermined distance therefrom.

2. The device of claim 1 wherein said reed switch is contained in an elongate capsule and said screw means comprises an internally threaded carrier, said elongate permanent biasing magnet being mounted on said carrier, said screw means further comprising an elongate adjustment screw mounted parallel to said elongate capsule, said adjustment screw being threaded through said carrier.

3. The device of claim 2 further comprising a protective switch housing containing said reed switch, said elongate permanent biasing magnet, and said screw means, said adjustment screw being rotatably mounted therein, and said switch housing having aperture means defined therein giving operative access to said adjustment screw.

4. The device of claim 3 wherein said housing has a flat interior surface and said carrier is made of resilient plastic material defining a hollow partial cylinder, said partial cylinder resiliently gripping around said screw and having interior threads mating with said screw, and said carrier having a flat side fitting in slidable relationship with said flat interior surface of said switch housing to prevent said carrier from rotating as said adjustment screw is rotated.

5. The device of claim 3 wherein said carrier comprises a generally rectangular piece defining an open-sided cylinder fitting around said screw means, and wherein said adhesive means for attaching comprises double-faced adhesive tape attaching said elongate permanent biasing magnet to said carrier.

6. The device of claim 1 wherein said reed switch is contained in an elongate capsule and said screw means comprises an elongate tube having an interior thread and a screw matingly threaded therein, said elongate tube being located adjacent and parallel to said elongate capsule, and said magnet being attached to an end of said screw by said adhesive means.

7. The device of claim 6 wherein said elongate tube is made of plastic material and includes channel means attached thereto for locating said elongate capsule parallel to said elongate tube.

8. The device of claim 1 further comprising permanent magnet actuating means for providing said external magnetic field.

9. The device of claim 8 wherein said actuating means comprises an actuating magnet disposed within an elongate tubular magnet housing, and said reed switch, said elongate permanent biasing magnet, and said screw means are disposed within elongate tubular switch housing, each said housing having at least one closed end, the axis of polarity of said actuating magnet and said longitudinal axis of said magnetic reed means being parallel to the longitudinal axes of said magnet housing and said switch housing respectively.

10. The device of claim 1 wherein each of said tubular housings includes retainer means for securely mounting said housings.

* * * * *